US005468096A

United States Patent [19]

Sauerwein et al.

[11] Patent Number: 5,468,096

[45] Date of Patent: Nov. 21, 1995

[54] MEANS FOR SECURING A COVER OVER A DRAINAGE CHANNEL

[75] Inventors: Heinrich Sauerwein, Nubbel; Wolfgang Arm, Rendsburg; Jan Witt, Eckernforde+, all of Germany

[73] Assignee: ACO Severin Ahlmann GmbH & Co., KG, Rendsburg, Germany

[21] Appl. No.: 161,936

[22] Filed: Dec. 3, 1993

[30] Foreign Application Priority Data

Dec. 10, 1992 [DE] Germany ..... 42 41 707.4

[51] Int. Cl.[6] ..... E02B 11/00

[52] U.S. Cl. ..... 405/36; 405/118

[58] Field of Search ..... 405/118, 119, 405/36; 404/2–5

[56] References Cited

FOREIGN PATENT DOCUMENTS

| | | |
|---|---|---|
| 612279 | 8/1990 | Australia . |
| 0081741A1 | 6/1983 | European Pat. Off. . |
| 0319811A1 | 6/1989 | European Pat. Off. . |
| 7936522 | 3/1980 | Germany . |
| 8802530.6 | 5/1988 | Germany . |
| 8802530 | 5/1988 | Germany . |
| 3827042A1 | 3/1989 | Germany . |
| 3736161A1 | 5/1989 | Germany . |
| 660386A5 | 4/1987 | Switzerland . |
| 1519357 | 7/1978 | United Kingdom . |
| 2133443 | 7/1984 | United Kingdom . |

*Primary Examiner*—David H. Corbin

*Attorney, Agent, or Firm*—Marshall, O'Toole, Gerstein, Murray & Borun

[57] ABSTRACT

A means for securing a cover to a drainage channel body defining a drainage channel and wherein said channel body defines at least two cutouts located substantially opposite one another in inner side walls defining said channel comprises at least one cross-bar and a fixing means. The cross-bar defines two ends that can be inserted respectively into said cutouts so that the cross-bar is disposed transversely across the drainage channel. A clamping means is located at at least one of the ends of the cross-bar to retain the cross-bar in place after insertion of its ends into the cut-outs. The fixing means attaches the cover to the channel body by way of attachment of the cover to the cross-bar.

16 Claims, 4 Drawing Sheets

MEANS FOR SECURING A COVER OVER A DRAINAGE CHANNEL

FIELD OF THE INVENTION

The present invention relates to surface drainage apparatus and in particular to a means for securing a cover to a drainage channel body over the drainage channel.

DESCRIPTION OF THE PRIOR ART

As described in German patent DE 79 36 522 U1, a conventional drainage channel has a web stretching across the channel which is cast into the channel body. In the middle of the web is a threaded bore, so that a cover set on to the channel body can be fixed by means of a screw bolt. This known arrangement is expensive to manufacture.

In European patent EP 82 111 076 A1 a securing device for a drainage channel is described as shown in FIGS. 11 and 12 of the drawings of the present application. Here, a channel body 1 is provided, the side walls 2 of which are connected by a bottom 5 and provided with reinforcing ribs 4. In the upper edges 3, 3' of the channel 1 support surfaces 6, 6' are provided on which a cover 30 can be placed.

In the cover 30 a bore is provided into which a fixing screw 16 can be inserted, its lower end being seated in a screw thread 15 of a pivoted cross-bar 80'. In the side walls 2, 2' of the channel 1 cutouts 7, 7' are defined which are partially opposite one another, i.e. offset from one another in a direction along the length of the channel as shown in FIG. 11. The cutouts 7, 7' are defined in part by a front wall 8, 8' and a back wall 9, 9'. In this known arrangement, when the cover 30 with inserted screw 16 and attached pivoted cross-bar 80' has been set on the support surfaces 6, 6' and the screw 16 is turned clockwise, the ends of the pivoted cross-bar 80' swing into the cutouts 7, 7', until the leading edges of the ends of the pivoted cross-bar 80' come into contact with the front walls 8, 8'. Continued turning of the screw 16 causes it to be screwed further into the screw-thread 15 in the pivoted cross-bar 80', so that the ends of the pivoted cross-bar 80' come to bear against the upper walls of the cutouts 7, 7' and the cover 30 is pulled firmly against the support surfaces 6, 6' of the channel 1. Although this known arrangement is very easy to manufacture, difficulties can be encountered during assembly. In particular, the pivoted cross-bar does not always swing completely into the cutouts 7, 7' so that it abuts the front walls 8, 8'. With the cross-bar incompletely positioned a high load per unit area is imposed, which in some circumstances is greater than the stability of the channel material, usually and preferably polymeric concrete, can withstand. However, since the cover is in place when the pivoted cross-bar is swung into the cutouts, no visual inspection is possible. Hence a connection that appears to be secure can become loosened or broken in the course of time. Moreover, this known securing arrangement is restricted exclusively to application in combination with a screw fastening by way of a single screw bolt, because it is only in this way that the necessary swinging movement of the pivoted cross-bar can be achieved.

SUMMARY OF THE INVENTION

The object of the present invention is to overcome or substantially mitigate the aforementioned problems to provide a securing device for a drainage channel wherein the attachment of a cover to the channel body that can take various forms all of which are durable.

According to a first aspect of the present invention there is provided a means for securing a cover to a drainage channel body defining a drainage channel wherein said channel body defines at least two cutouts located substantially opposite one another in inner side walls defining said channel, and comprising at least one cross-bar defining two ends that can be inserted respectively into said cutouts so that the cross-bar is disposed transversely across the drainage channel,a clamping means located at at least one of said ends of said cross-bar to retain the cross-bar in place after insertion of said ends into said cut-outs, and a fixing means for attachment of said cover to said channel body by way of attachment of said cover to said cross-bar.

Thus, although the cross-bar can be retrofitted, e.g. by a rotational movement, so that there is no need to change the construction of a conventional channel body with its cutouts, the process of positioning the cross-bar can now be carried out with the cover removed. It is therefore possible to position the cross-bar correctly, i.e. so that it is completely inserted into the cutouts, the clamping means ensuring that it will be held permanently in this position.

Preferably, the clamping means is located at both ends of said cross-bar which is thereby made substantially symmetrical. With this arrangement the cross-bar is held more firmly in the channel.

It is possible to use manually operated spring bolts or the like as clamping devices. Preferably, however, the clamping means is resiliently deformable so that during insertion of the ends of the cross-bar into the cutouts the clamping means is resiliently deformed. As a result, the need for special operation of the clamping devices is eliminated.

Preferably also, the clamping means is captively attached to the cross-bar. This facilitates the insertion process.

The insertion process is particularly simple when the clamping means is inserted by a rotational movement in a plane parallel to the surface of the cover.

The securing means is particularly economical and simple to manufacture when the cross-bar and the clamping means are formed from sheet metal. Preferably, the clamping means is formed integrally with the cross-bar.

Preferably also, the cross-bar defines a substantially U-shaped transverse cross sectional shape with a base and two side limbs, and the clamping means comprises strips bent out of the plane of the limbs and separated from the base.

Preferably also, the clamping means comprises claws which can engage the channel body when the cross-bar is inserted therein. In this case disengagement of the cross-bar is possible only with great effort using tools. In an alternative embodiment of the invention the clamping devices are shaped at their ends so that removal is possible. In this case the torque required for removal is preferably greater than that needed for insertion.

According to a second aspect of the present invention the securing means forms part of a conversion kit for the replacement of a pivoted cross-bar as described in European patent EP 0081 741 A1 wherein the cover is secured to the cross-bar arrangement by screw means. In this case, the fixing means comprises a screwless fixing means which cannot be used in the conventional arrangement because it would eliminate rotational movement required for correct location of the cross-bar.

Preferably, the screwless fixing means comprises a first fixing element for attachment to the cross-bar and a complementary second fixing element for attachment to the cover, the first fixing element comprising a clamping spring defining a receiving opening, the second fixing element comprising a peg formed with an enlarged end that is a leading end for insertion of said peg into said clamping spring, and the clamping spring and the peg being constructed so that the peg can be inserted into the receiving opening, thereby elastically deforming the spring, and retained therein after insertion in a direction substantially perpendicular to the plane of the cover. Thus all that is required of the user is pressing of the cover on to the channel body.

Preferably, the enlarged end is biconical in form with a first vertex at said leading end and a second vertex pointing away from said leading end at a less acute angle than said first vertex. As a result, the forces required for assembly are smaller than those needed to lift the cover away.

Preferably also, the receiving opening is of elongate shape and the peg can be inserted therein at any point along the length of the receiving opening. As a result, even with large tolerances there can be no difficulty in insertion.

Preferably also, the clamping spring is attached to the cross-bar with sufficient play that the peg can move the clamping spring during insertion into the receiving opening. This play allows further compensation.

Preferably also, the receiving opening is of elongate shape and the peg can be inserted therein at any point along the length of the receiving opening, and the clamping spring is attached to the cross-bar with sufficient play in a direction perpendicular to the long axis of the receiving opening so that the peg can move the clamping spring in a direction perpendicular to the long axis during insertion into the receiving opening. The result is a more stable structure, play compensation being in only one direction in each case, that nevertheless as a whole allows play compensation in all possible directions.

The clamping spring can comprise a plastics component or a steel strip, preferably of stainless steel. In a preferred embodiment the clamping spring substantially comprises a ribbon shaped to define an open looped portion and two opposed curved retaining sections, each of which is continuous at one end with an end of said looped portion and curved outwards of said looped portion at its other end, and the clamping spring is seated in such a way that said outwardly curving other ends of the clamping spring overlap opposite edges defining its seating. Hence, with suitable dimensioning, the clamping spring can be displaced within the opening, so that the edges of the opening can be pushed more or less far into the retaining sections of the clamping spring.

In simpler embodiments of the invention, the peg is firmly screwed to the cover (e.g., in place of the known screw 16). Increased security against undesired lifting of the cover can be provided by an arrangement distinguished by the fact that the peg can be rotated about its long axis and its enlarged end has two surfaces on opposite sides thereof which are spaced by a distance substantially equal to the diameter of said enlarged end so that when said surfaces are apposed to the retaining sections of the clamping spring the peg expands the clamping spring to permit the peg to be withdrawn from the clamping spring via the receiving opening.

The various aspects of the present invention will now be described by way of example with reference to the accompanying drawings.

DESCRIPTION OF THE PREFERRED EMBODIMENTS

Figure 1:
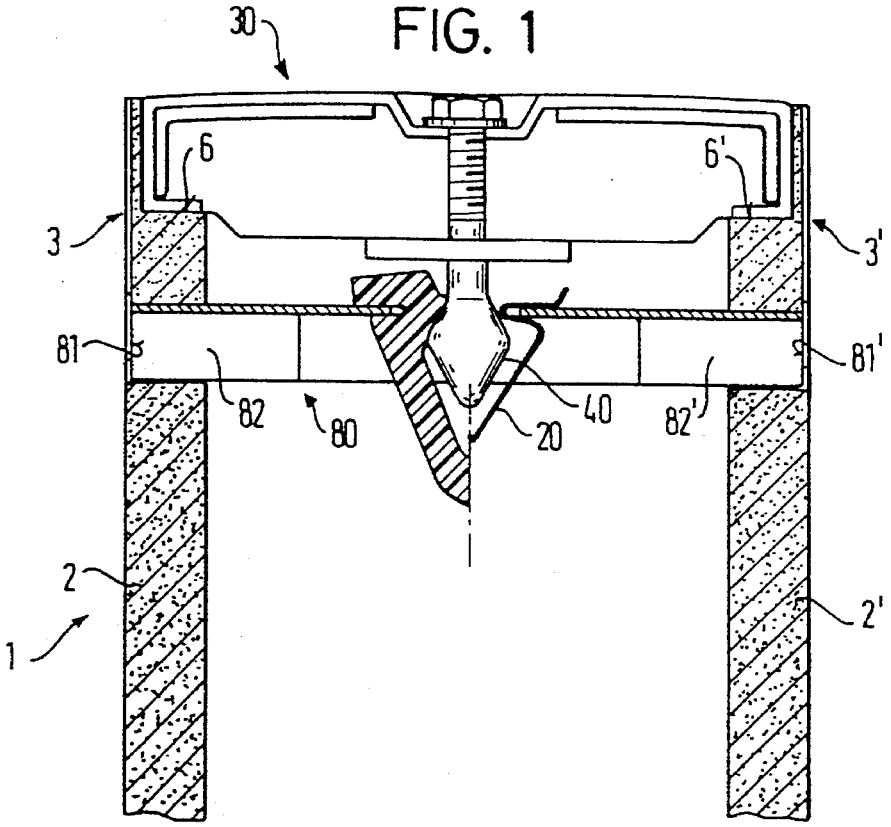
FIG. 1 is a vertical cross section through a drainage channel with an attached cover.

In the following description the same reference numerals are used for the same elements of the invention or for parts with the same function.

FIG. 1 shows part of a drainage channel body 1, parallel side walls 2, 2' of which define cutouts 7, 7' situated a relatively short distance below an upper edge 3, 3' or under support surfaces 6, 6' for a cover 30. These cutouts 7, 7' are similar to the cutouts of the prior art described above with reference to FIGS. 11 and 12.

Figure 2:
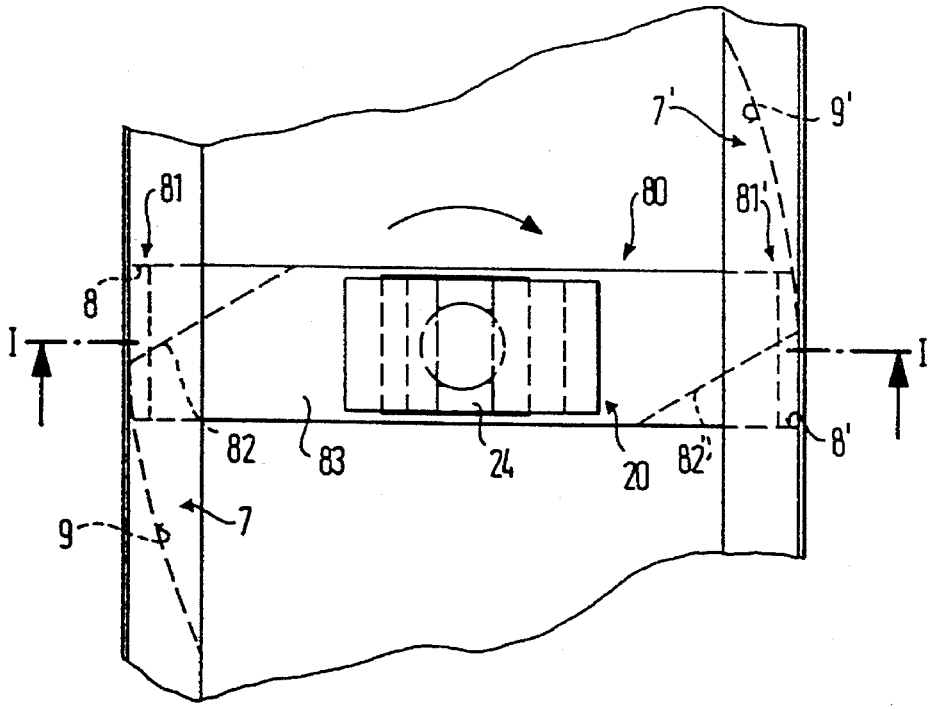
FIG. 2 is a plan view of the channel shown in FIG. 1 but with the cover removed.
Figure 3:
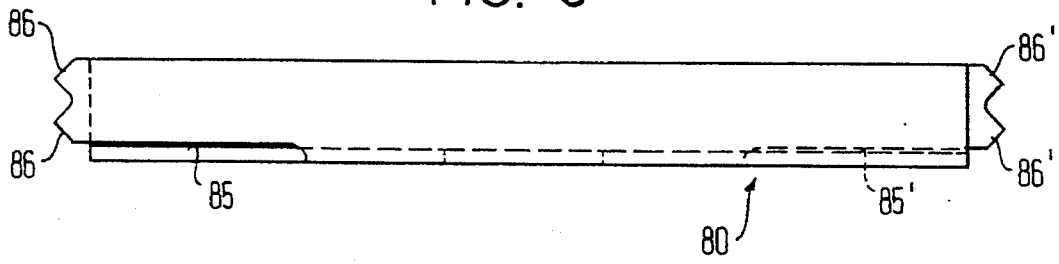
FIG. 3 is a side view of a first embodiment of a cross-bar.
Figure 4:
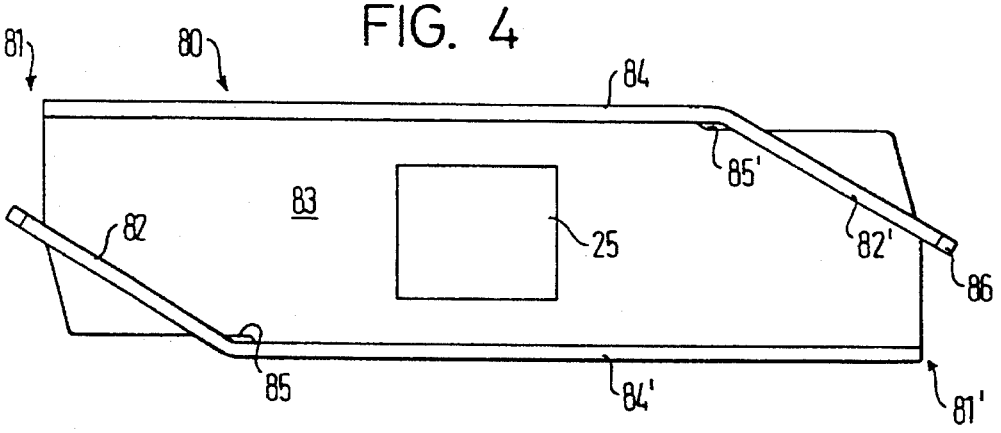
FIG. 4 is a plan view of the cross-bar shown in FIG. 3.
Figure 5:
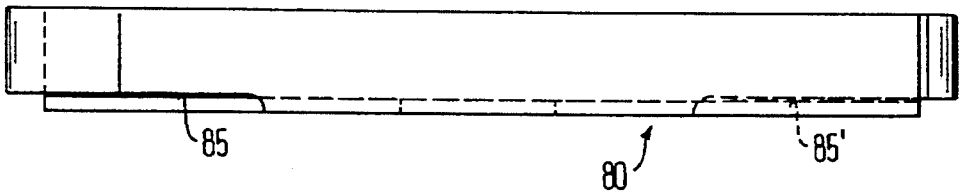
FIG. 5 is a side view of a second embodiment of a cross-bar.
Figure 6:
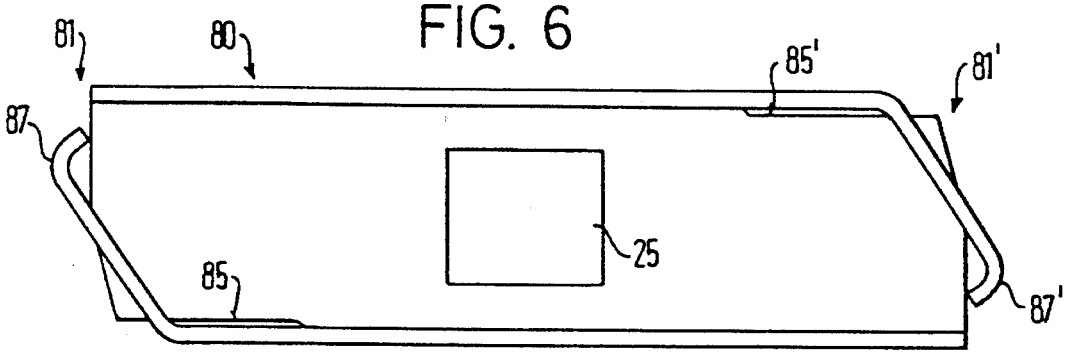
FIG. 6 is a plan view of the cross-bar shown in FIG. 5.

Into the cutouts 7, 7' the ends 81, 81' of a cross-bar 80 can he inserted. The cross-bar 80 is of U-shaped cross section, as shown in FIGS. 3 to 6, and comprises a base 83, which is substantially parallel to the cover 30, and two flanges or limbs 84, 84'. Each of the flanges 84, 84' is separated from the base 83 at one or other end 81, 81' of the cross-bar 80 respectively, along a separating line 85 or 85'. This separation produces two strips 82, 82', each of which is bent inward toward the opposite limb 84, 84' respectively. As a result, the strips 82, 82' form clamping means. These can either terminate in a smooth surface as shown in FIGS. 1 and 2, or be provided with claws 86, 86' as shown in FIGS. 3 and 4 or rounded ends 87, 87'. The smooth-ended cross-bars 80 or, to a greater extent, those with claws 86, 86' can he disengaged only with relatively great effort, for example by forcing in a screwdriver or the like, whereas the cross-bars 80 with rounded ends 87, 87' can be removed from the channel 1 by powerful counterclockwise rotation. During insertion, the cross-bar 80 is rotated clockwise, as indicated by the arrow in FIG. 2, so that the ends 81, 81' swing into the cutouts 7, 7'. Each of the clamping devices 82, 82' is thereby bent toward the opposite limb 84, 84', offering only relatively slight resistance to the rotational movement. This rotation process continues until the cross-bar 80 abuts the front walls 8, 8' of the cutouts 7, 7' at its ends, in particular at the end sections of the base 83. When the cross-bar 80 is rotated back, in a direction opposite that shown by the arrow in FIG. 2, the clamping strips 82, 82' apply a spring force against the surface of the cutout. If they have rounded ends 87, 87' as shown in FIGS. 5 and 6, this force can be more readily overcome. Hence the construction, installation and dismantling of the cross-bar 80 is simple.

The cross-bars 80 as described above can be provided with a screw threaded bore 15 like a conventional cross-bars, as described previously with reference to FIGS. 11 and 12, to enable attachment of a cover 30 to the cross-bar 80 by means of a screw 16.

Figure 11:
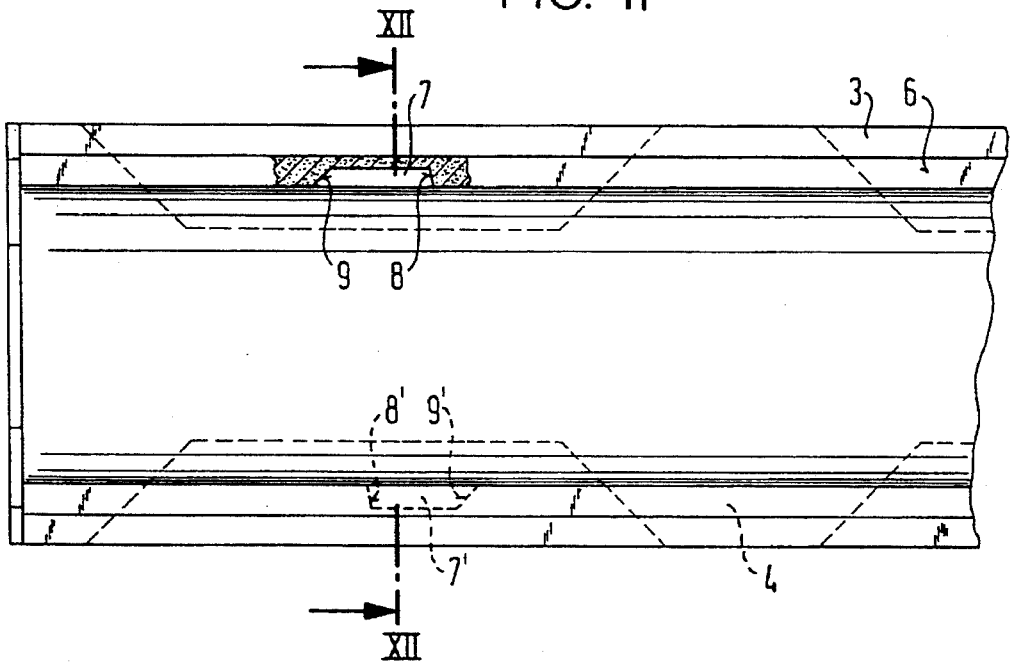
FIG. 11 is a plan view of a conventional drainage channel.
Figure 12:
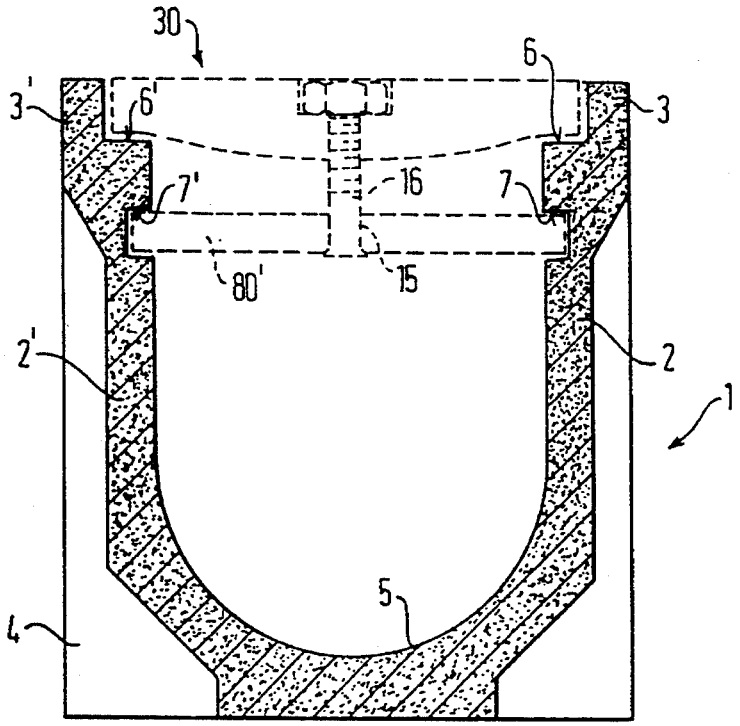
FIG. 12 is a section along the line XII—XII in FIG. 11.

However, an advantage of a cross-bar in accordance with the invention is that it enables a conventional drainage channel as shown in FIGS. 11 and 12, even when already installed with a screw-fitted cover to be converted to one wherein the cover is attached by a screwless fixing means. Such a screwless fixing means will now be described with reference to FIG. 1 and FIGS. 7 to 10 of the drawings.

The screwless fixing means comprises a first fixing element 20 that is attached to the channel body 1 via the cross-bar 80 and a complementary fixing element 40 that is attached to the cover 30. The two fixing elements 20 and 40 can be brought into snap-action engagement with each other as will be described.

Figure 8:
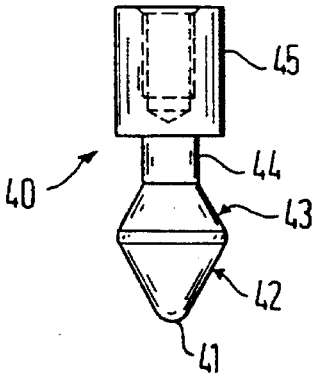
FIG. 8 is a side view of a fixing element.

The fixing element 40 comprises a peg, as shown in FIGS. 1 and 8, which defines a biconical enlarged end with a tip 41 at the end of a conical surface 42. The tip forms the leading end for insertion of the peg into the complementarily shaped fixing element 20. The conical surface 42 is continuous with a second conical retaining surface 43 that slants in the opposite direction, the angle of the retaining surface 43 being greater than that of the conical surface 42, so as to form the enlarged end. The retaining surface 43 is continuous with a shaft 44, which in turn is integral with a head 45. In the illustrated embodiment, the head 45 defines a threaded bore so that it can be attached to a cover 30 by means of a screw, as shown in FIG. 1. The fixing element 40 thus replaces the screw 16 of the prior art.

Figure 7:
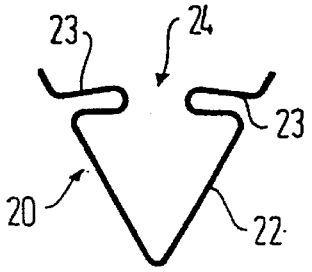
FIG. 7 is a cross section through a clamping spring.

The complementary fixing element 20 comprises a clamping spring with a lower spring portion 22 which is looped into a substantially U- or V-shape in cross section (see FIG. 7). At the upper end of the clamping spring 20 two U-shaped retaining sections 23, 23' are provided, each of which is integral with the lower spring portion 22 by one of its limbs, The openings of the retaining sections 23, 23' face outwards so that an elongated receiving opening 24 is formed between them. The clamping spring 20 thus comprises a leaf spring (see FIG. 2) and when the cover 30 is placed on the channel body 1, positioning of the tip 41 of the fixing element 40 at an appropriate position along the longitudinal direction of the drainage channel relative to the receiving opening 24 is not too critical. Tolerances can thereby be compensated.

Located in the middle of the cross-bar 80 is a substantially rectangular opening 25, as shown in FIGS. 4 and 6. Into this opening 25, a fixing element 20 as shown in FIG. 7 can be inserted in such a way that the limbs of the retaining sections 23 and 23' overlap the edges of the opening 25 and come to rest on and under the base 83 of the cross-bar 80. The width of the opening 25 in the longitudinal direction of the channel body 1 is made to correspond to the width of the retaining sections 23, 23', so that the fixing element 20 is held substantially without play in the cross-bar 80 with respect to said longitudinal direction. The length of the opening 25 transverse to the longitudinal axis of the channel and the opening width of the retaining sections 23, 23' are dimensioned so that the fixing element 20 can be displaced transversely with respect to the longitudinal axis of the channel during insertion of a fixing element 40 therein. As a result, an additional tolerance compensation is achieved, at right angles to the longitudinal direction of the receiving opening 24.

The fixing element 20 when in the form of a clamping spring can be made either of metal, as shown in the right half of FIG. 1, or of a plastics material, as shown in the left half of FIG. 1. The material, and in particular material pairings, are chosen so that corrosion can be substantially prevented. This can also be achieved by passivation of appropriate surfaces.

Increased security against undesired lifting of the cover can be provided by an arrangement wherein the peg has two surfaces on opposite sides thereof which are spaced by a distance substantially equal to the diameter of said enlarged end so that when said surfaces are apposed to the retaining sections of the clamping spring the peg expands the clamping spring to permit the peg to be withdrawn from the clamping spring via the receiving opening.

Figure 9:
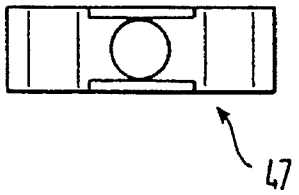
FIG. 9 is a plan view of a retaining means for the fixing element.
Figure 10:
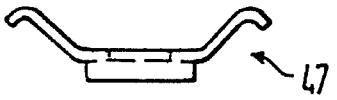
FIG. 10 is a side view of the retaining means shown in FIG. 9.

Dependent on which kind of drainage channel is to be converted, i.e. one with a cast grating cover or one with a sheet-metal grating cover, the peg 40 can be attached to the cover 30 either directly or by way of a retaining means 47 for use with grids as shown in FIG. 9. Here the retaining means 47 comprises a threaded bore, so that in the fixing element 40 instead of being provided with a screw-threaded bore in the head 45, as shown in FIG. 8, is provided with an external screw-thread to enable it to be screwed into the threaded bore of the retaining means 47.

This is can be seen that the means for securing a cover to a drainage channel body over the drainage channel can be employed in a versatile manner and used in already existing arrangements and combined with already existing fixing means, in particular a screwless fixing means.

What is claimed is:

1. A means for securing a cover to a drainage channel body defining a drainage channel wherein said channel body is provided with at least two cutouts located substantially opposite one another in inner side walls defining said channel, and comprising:

at least one cross-bar having two ends for inserting respectively into said cutouts so that the cross-bar is fixedly mounted transversely across the drainage channel, a clamping means located at at least one of said ends of said cross-bar for retaining said cross-bar in place after insertion of said ends into said cutouts, and a fixing means for attachment of said cover to said channel body including means for attachment of said cover to said cross-bar, wherein said clamping means is resiliently deformable so that the force needed to deform it resiliently during insertion of said ends of said cross-bar into said cutouts is less than the force needed to disengage said cross-bar from said channel body.

2. A means as claimed in claim 1, wherein said clamping means is located at both ends of said cross-bar which is thereby made substantially symmetrical.

3. A means as claimed in claim 1, wherein said clamping means is captively attached to said cross-bar.

4. A means as claimed in claim 1, wherein said ends are inserted respectively into said cutouts to bring said clamping means into operation by rotational movement of said cross-bar in a plane parallel to the surface of said cover.

5. A means as claimed in claim 1, wherein said cross-bar and said clamping means are formed from sheet metal.

6. A means as claimed in claim 5, wherein said clamping means is integral with said cross-bar.

7. A means as claimed in claim 6, wherein said cross-bar defines a substantially U-shaped transverse cross sectional shape with a base and two side limbs, and wherein said clamping means comprises strips bent out of the plane of the limbs and separated from the base.

8. A means as claimed in claim 1, wherein said clamping means comprises claws which can engage said channel body when said cross-bar is inserted therein.

9. An improved surface drainage apparatus including cover securing means for securing a cover to a drainage channel body defining a drainage channel wherein said channel body is provided with at least two cutouts located substantially opposite one another in inner side walls defining said channel, said cover securing means including:

a cross-bar arrangement including at least one cross-bar having two ends for inserting respectively into said cutouts so that the cross-bar is fixedly mounted transversely across the drainage channel;

a fixing means including screw means for attachment of said cover to said cross-bar, and clamping means for retaining said cross-bar in place after insertion of said ends into said cutouts, wherein said clamping means is resiliently deformable so that the force needed to deform it resiliently during insertion of said ends of said cross-bar into said cutouts is less than the force needed to disengage said cross-bar from said channel body, wherein said improvement comprises a conversion kit to convert said cross-bar arrangement wherein said cover is secured to said cross-bar by screw means, said conversion kit comprising fixing means including means for attachment of said cover to said cross-bar comprising a screwless fixing means.

10. An improved surface drainage apparatus as claimed in claim 9, wherein said screwless fixing means comprises a first fixing element for attachment to said cross-bar and a complementary second fixing element for attachment to said cover, said first fixing element comprising a clamping spring defining a receiving opening, said second fixing element comprising a peg formed with an enlarged end that is a leading end for insertion of said peg into said clamping spring, and said clamping spring and said peg being constructed so that said peg can be inserted into said receiving opening, thereby elastically deforming the spring, and retained therein after insertion in a direction substantially perpendicular to the plane of the cover.

11. An improved surface drainage apparatus as claimed in claim 10, wherein said enlarged end is biconical in form with a first vertex at said leading end and a second vertex pointing away from said leading end at a less acute angle than said first vertex.

12. An improved surface drainage apparatus as claimed in claim 10, wherein said receiving opening is of elongate shape and said peg can be inserted therein at any point along the length of said receiving opening.

13. An improved surface drainage apparatus as claimed in claim 11, wherein said clamping spring is attached to said cross-bar with sufficient play that said peg can move said clamping spring during insertion into said receiving opening.

14. An improved surface drainage apparatus as claimed in claim 10, wherein said receiving opening is of elongate shape and said peg can be inserted therein at any point along the length of said receiving opening, and said clamping spring is attached to said cross-bar with sufficient play in a direction perpendicular to the long axis of said receiving opening so that said peg can move said clamping spring in a direction perpendicular to said long axis during insertion into said receiving opening.

15. An improved surface drainage apparatus as claimed in claim 10, wherein said clamping spring substantially comprises a ribbon shaped to define an open looped portion and two opposed curved retaining sections, each of which is continuous at one end with an end of said looped portion and curved outwards of said looped portion at its other end, and wherein said clamping spring is seated in such a way that said outwardly curving other ends of said clamping spring overlap opposite edges defining its seating.

16. An improved surface drainage apparatus as claimed in claim 15, wherein said peg can be rotated about its long axis and said enlarged end has two surfaces on opposite sides thereof which are spaced by a distance substantially equal to the diameter of said enlarged end so that when said surfaces are apposed to said retaining sections of said clamping spring said peg expands said clamping spring to permit said peg to be withdrawn from said clamping spring via said receiving opening.

* * * * *